US006280567B1

(12) United States Patent
Gustavsson et al.

(10) Patent No.: US 6,280,567 B1
(45) Date of Patent: Aug. 28, 2001

(54) SYSTEM AND METHOD FOR TREATMENT OF CELLULOSE-CONTAINING MATERIAL PRIOR TO PULP DIGESTION

(75) Inventors: Lennart Gustavsson, Karlstad (SE); Johan Engstrom, Esbo (FI); Vidar Snekkenes, Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/529,460

(22) PCT Filed: Oct. 9, 1998

(86) PCT No.: PCT/SE98/01817

§ 371 Date: Apr. 12, 2000

§ 102(e) Date: Apr. 12, 2000

(87) PCT Pub. No.: WO99/20827

PCT Pub. Date: Apr. 29, 1999

(30) Foreign Application Priority Data

Oct. 16, 1997 (SE) ..... 9703762

(51) Int. Cl.[7] ..... D21C 11/06

(52) U.S. Cl. ..... 162/14; 162/15; 162/18; 162/19; 162/68; 162/239; 162/248

(58) Field of Search ..... 162/17, 19, 41, 162/47, 52, 239, 248, 246, 18, 15, 68

(56) References Cited

U.S. PATENT DOCUMENTS

H1681 * 10/1997 Johanson et al. ..... 162/243
3,258,390 * 6/1966 Tomlinson, II ..... 162/17
3,814,662 * 6/1974 Starrett ..... 162/19
4,496,426 * 1/1985 Baumeister et al. ..... 162/19
4,632,729 * 12/1986 Laakso ..... 162/17
5,635,025 * 6/1997 Bilodeau ..... 162/17

* cited by examiner

*Primary Examiner*—Dean T. Nguyen
(74) *Attorney, Agent, or Firm*—Fasth Law Offices; Roth Fasth

(57) ABSTRACT

The invention relates to a process system and a method for preliminary treatment of disintegrated cellulose-containing material, preferably wood chips, prior to pulp digestion. The process system and the method according to the invention make use of a process vessel intended to function both as a so-called chip bin and as a pre-impregnation vessel. The characteristics of the invention are that a sloping steaming vessel is arranged downstream of the process vessel for the purpose of separating an excess of pre-impregnation liquid from the pre-impregnated cellulose-containing material, that the sloping steaming vessel is arranged for supplying steaming vapor which preferably has been generated by flashing of extraction liquor from a pulp digester, and that the sloping steaming vessel is connected to a chip chute communicating with a condenser for connection to a system for managing foul-smelling process gases. The invention can be applied in the production of pulp which is intended for paper manufacture or other applications where cellulose fibers are used.

7 Claims, 1 Drawing Sheet

SYSTEM AND METHOD FOR TREATMENT OF CELLULOSE-CONTAINING MATERIAL PRIOR TO PULP DIGESTION

TECHNICAL FIELD

The present invention relates to a process system and a method for preliminary treatment of disintegrated cellulose-containing material, preferably wood chips, prior to pulp digestion.

The process system and the method according to the invention make use of a process vessel intended to function both as a so-called chip bin and as a pre-impregnation vessel, and a so-called sloping steaming vessel.

The invention further concerns the areas of energy optimization and the management of foul-smelling gases.

The invention can be applied to the production of pulp which is intended for paper manufacture or other applications where cellulose fibres are used.

TECHNICAL BACKGROUND

Chemical cellulose pulp is at present produced by delignifying wood chips with the aid of suitable cooking liquid in pulp digesters designed for this purpose.

Raw materials for pulp production are preferably various types of softwood, for example spruce or pine, or hardwood such as eucalyptus, birch or aspen. In recent times, alternative fibrous raw materials have also come into use to some extent in pulp production.

Examples of such raw materials are straw, reed-grass and esparto.

Today, most paper pulp is produced using continuous pulp digesters, of which there are at present a number of different types, for example hydraulic digesters and steam/liquor phase digesters.

The simplest type of steam/liquor phase digester is of the single-vessel type and is suitable for easily impregnatable wood types such as eucalyptus and other hardwood raw materials.

A further development of this type of digester is represented by the so-called two-vessel steam/liquor phase digesters which are provided with a separate pre-impregnation vessel in which the wood chips are saturated with the desired liquid before the actual delignification or cooking begins. Two-vessel steam/liquor phase digesters are especially suitable for wood types which are difficult to impregnate, for example pine.

Thus, there are a number of different types of digester arrangements which can be used for pulp digestion. In this connection, a number of different cooking liquids can be used for delignifying the wood and releasing the cellulose fibres. The active constituent in a cooking liquid often gives the name of the whole process, for which reason an alkaline cooking process with sulphur-containing cooking liquid is called a sulphate process, while an acid or in some cases neutral cooking process with sulphur-containing cooking liquid is called a sulphite process. Other known pulp digestion processes which may be mentioned, among others, are the soda process and the soda-anthraquinone process.

After the pulp digestion or delignification has taken place in a pulp digester, the pulp fibres released from the wood can be cleaned in different ways, for example by pulp washing, in which cooking liquid and released wood substances are removed, and by screening, in which impurities and non-defibred material such as shives and knots are removed.

In the case of unbleached pulp which is to be used in an integrated paper mill, the pulp is ready for use after the abovementioned cleaning stage and can be pumped onwards to a paper-making machine. In the case of a pulp mill for bleached market pulp, the pulp digestion and cleaning stage are followed by an additional bleaching sequence, a pulp wet-machining sequence, a drying sequence and usually also a baling sequence. In the case of flash-dried pulp, the pulp wet-machining sequence is omitted.

The reasons for pulp being bleached are on the one hand to remove remaining impurities and on the other hand to obtain a higher brightness of the pulp when this is required. The bleaching was previously carried out to a large extent using chlorine gas and sodium hydroxide in different sequences. Today, however, primarily for environmental reasons, a large number of new bleaching processes have been developed, in which chlorine gas has more or less been eliminated, and bleaching chemicals such as chlorine dioxide, hydrogen peroxide and ozone are increasingly used.

In the manufacture of chemical pulp, the pulp production process generally starts from pulp wood which is first debarked and cut up into chips in devices provided for this purpose, after which the chips are screened in order to remove impurities and chips of differing sizes. The chips are usually stored in the interim in a chip stack or in another similar chip store, and are thereafter transported to a chip silo, also called a chip bin, from which the wood chips are metered onwards in the process.

After the chip bin, or in some cases also inside the chip bin, the wood chips are usually treated with the purpose of removing air from the wood and preparing it for impregnation in a pre-impregnation stage. This is done by so-called steaming, which involves the wood chips being exposed to hot water vapour. In this steaming, the hot vapour drives out any air which is enclosed in the wood, at the same time as the wood chips are heated and saturated with moisture. This affords a certain softening of the wood material and prepares the chips for the impregnation phase, which is carried out in a subsequent process stage.

After the steaming stage, the wood chips are generally conveyed through at least one feeder. A feeder generally consists of a rotary vane feeder which allows wood chips to be passed through between vessels which are at different pressures. Depending on the pressure difference between the vessels which a feeder connects, such an arrangement is called either a low-pressure feeder or a high-pressure feeder. A high-pressure feeder allows the wood chips to be passed in to the pre-impregnation vessel, which is usually at a relatively high pressure. In the pre-impregnation vessel, the wood chips are impregnated with an impregnation liquid which generally consists of fresh and/or recycled cooking liquid and which in the case of sulphur-containing alkaline cooking liquids is called white liquor or black liquor.

After the pre-impregnation stage, the impregnated wood chips are transported onwards to a pulp digester for cooking.

In recent times, process developments within the area of pulp production have been increasingly aimed at reducing energy consumption and process discharges. Of course, the developments have also been aimed at reducing the production and investment costs and at simplifying manufacture, running and servicing.

Thus, international patent application number PCT/US/95/15458 describes a system and a method for feeding chips, which system and method are said to result in a simplified chip-feeding system for a continuous digester which can be used also for batch digesters.

The system is reported to comprise a single vessel with a top and a bottom, which vessel is said to have the same functions of a conventional chip bin, a conventional steaming vessel and a conventional chip trough, also called a chip chute.

The system described in PCT/US/95/15458 is said to afford an appreciable reduction in the costs involved in constructing and operating a chip-feeding system for a continuous digester.

It is further stated in PCT/US/95/15458 that the system described therein uses a process comprising: in a first stage, enclosing finely divided cellulose-containing fibrous material in a predetermined, open volume; thereafter, in the said volume, establishing a first level of fibrous material and a second level, beneath the first level, of cooking liquid; exposing the fibrous material between the first level and the second level to steam with the purpose of steaming the fibrous material; suspending the fibrous material with cooking liquid under the second level in order to produce a sludge; and removing the sludge from the said volume, pressurizing the sludge and feeding the pressurized sludge to a continuous digester.

In PCT/US/95/15458 it is also stated that the vapour added for steaming can, for example, originate from any available steam source in the mill, and can for example consist of fresh steam. However, it is stated that steam which has been produced from expanded cooking liquid may contain undesirable, totally reduced sulphur gases which have to be collected and destroyed, and that fresh steam is therefore preferred. It is further stated that the liquid used for impregnation is cooking liquid, for example black liquor, white liquor, green liquor or sulphite cooking liquid.

Something which may be experienced as a disadvantage of the previously disclosed technique is the difficulty in managing the foul-smelling gases which arise in the case where extraction liquor from a pulp digester is used for generating steaming vapour.

Another disadvantage which may be experienced with the previously disclosed technique is that the production of fresh steam for steaming, like the process as a whole, generally requires a great deal of energy.

DESCRIPTION OF THE INVENTION

Thus, a first object of the present invention is to make available a process system by which it is possible to use the thermal energy existing within the process in an optimum way and which allows foul-smelling gases to be managed in a reliable manner.

This first object is achieved by the fact that the process system according to the invention comprises a process vessel for pre-impregnation of cellulose-containing material with pre-impregnation liquid, a steaming vessel for steaming of pre-impregnated cellulose-containing material, and a high-pressure feeder with attachment to a pulp digester, the process vessel, during operation, being at a pressure at or close to atmospheric pressure, that the steaming vessel in this case is a sloping steaming vessel which is arranged downstream of the process vessel for the purpose of separating an excess of pre-impregnation liquid from the pre-impregnated cellulose-containing material, and that the sloping steaming vessel is arranged for supplying steaming vapour which preferably has been generated by flashing of extraction liquor from the pulp digester, and that the sloping steaming vessel is connected to a chip chute communicating with a condenser for connection to a system for managing foul-smelling process gases.

A second object of the present invention is to make available a method which makes use of the process system according to the invention.

This second object of the invention is achieved by the fact that the method according to the invention comprises pre-impregnation in a process vessel which is at a pressure at or close to atmospheric pressure, and steaming in a steaming vessel, and that in this case pre-impregnation takes place upstream of steaming and that the steaming takes place in a sloping steaming vessel, that the greater part of all the liquor which is to be conveyed to chemical recovery is separated off between the pre-impregnation and the steaming with the aid of the sloping steaming vessel, that the liquor undergoes heat exchange after separation and is then divided into a first subsidiary stream of liquor and a second subsidiary stream of liquor, that steaming vapour is preferably generated by flashing of extraction liquor, and that foul-smelling gases from pre-impregnation and steaming are collected and dealt with.

BRIEF DESCRIPTION OF THE FIGURES

The invention will now be described with reference to attached FIG. 1, which shows a diagrammatic representation of a process system according to a preferred embodiment of the invention.

As will be evident to the skilled person, FIG. 1 includes only those process components and flows which are essential to an understanding of the present invention. In complete process systems according to the invention there are a number of additional process flows, conduits, valves, process control equipment and other process components.

DETAILED DESCRIPTION OF PREFERRED EMBODIMENTS

Figure 1:
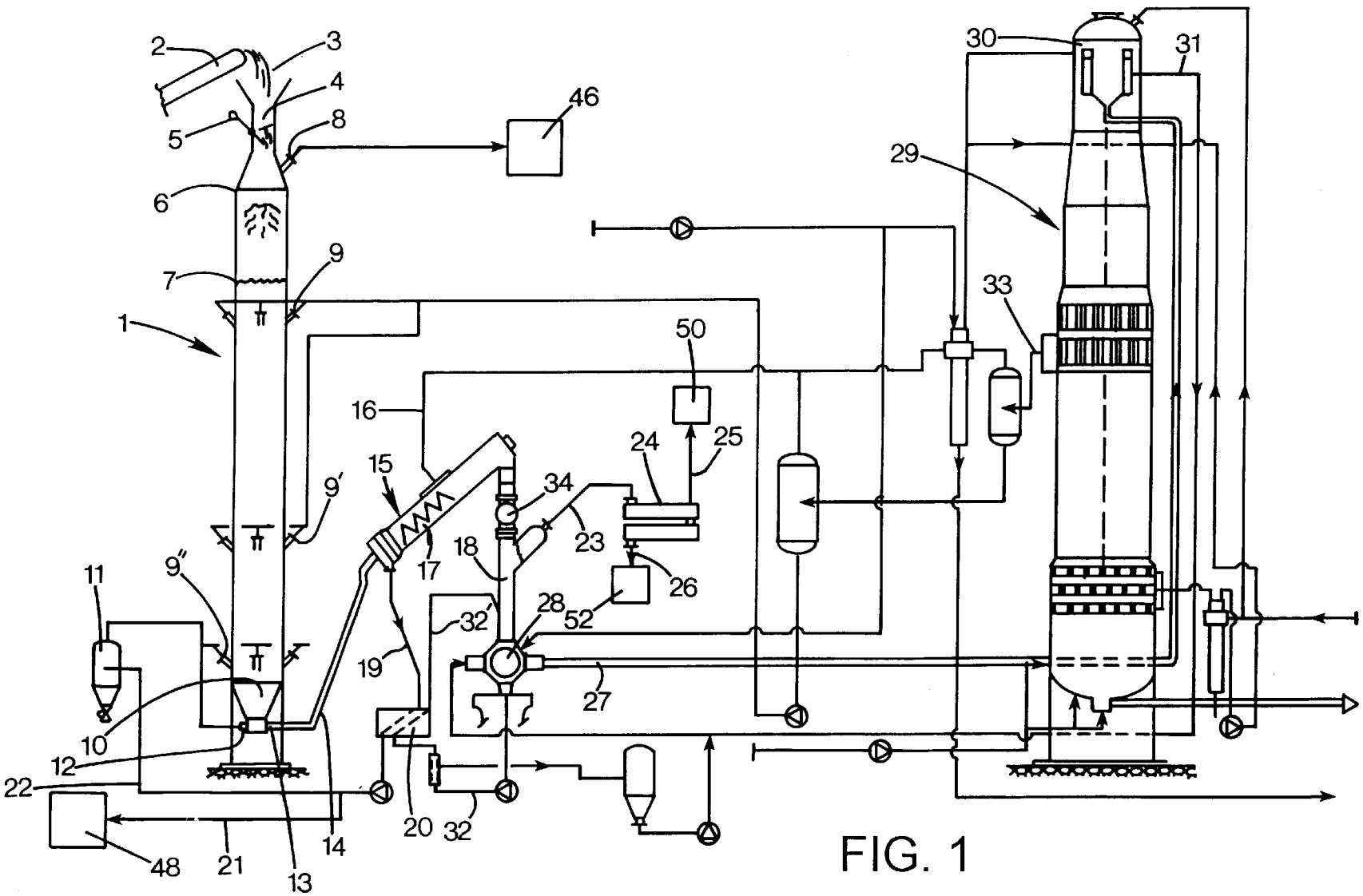

With reference to attached FIG. 1, a preferred embodiment of a process system according to the invention will now be described.

In the described embodiment, the process system according to the invention comprises a process vessel 1, in the described embodiment a chip container, which is intended to function both as chip bin and pre-impregnation vessel.

At the upper part of the process vessel 1 there is a conveyor 2, of a construction known per se, arranged for supplying disintegrated cellulose-containing material, i.e. wood chips 3, to the top opening 4 of the process vessel. The top opening 4 is provided with a valve flap 5, the function of which is to prevent inadvertent release of foul-smelling gas from the interior of the process vessel 1.

During operation, the disintegrated cellulose-containing material, in the described embodiment wood chips 3, fills the process vessel 1 up to a material level 6. The process vessel 1 is also filled, during operation, with pre-impregnation liquid up to a liquid level 7.

In the process vessel 1, the material level 6 is higher than the liquid level 7. This prevents temperature breakdown and gives the chip column which is formed inside the process vessel 1 an extra weight, something which facilitates the downward movement in the process vessel 1.

The process vessel 1 is further provided at its upper part with a gas outlet 8 for attachment to a foul-smelling gas process system 46 (not shown) for managing foul-smelling process gases.

Pre-impregnation liquid is delivered through a number of different liquid inlets 9, 9', 9" at different heights of the process vessel 1. This means that the pre-impregnation liquid is delivered at different stages of the preliminary treatment process taking place inside the process vessel 1.

The temperature of the pre-impregnation liquid is in this case controlled such that the pre-impregnation liquid entering the process vessel via the liquid inlets 9, 9', 9" has a temperature of between 130 and 140° C. After the pre-impregnation liquid has been suitably distributed in and mixed with the disintegrated cellulose-containing material, i.e. the wood chips, this results in a process temperature, within the process vessel 1, which during operation is lower than 100° C. at the top of the process vessel and higher than 100° C. at the bottom of the process vessel.

The process vessel 1 is further provided at its lower part with a discharge device 10, equipped with pumping liquid inlet 12 and material outlet 13.

The discharge device 10 is driven by pressurized pre-impregnation liquid which, from a separate cooperating pressure vessel 11, is forced into the discharge device located inside the process vessel 1. At the same time, material coming from above, i.e. wood chips, is pressed by its own weight down into a funnel-shaped, upwardly directed opening of the discharge device 10 and, with the aid of the pre-impregnation liquid forced in via the pumping liquid inlet 12, is fed out from the process vessel 1 via the material outlet 13.

The process vessel 1 of the process system according to the invention is at atmospheric pressure or at a pressure which is close to atmospheric pressure.

By means of the discharge device 10, the pre-impregnated material, i.e. wood chips 14, is pumped onwards to a sloping steaming vessel 15. Inside the sloping steaming vessel 15, the pre-impregnated chips are exposed to a further preliminary treatment stage in the form of steaming with steaming vapour 16, which preferably originates from flashing of extraction liquor 33 in one or more stages. The pressure inside the sloping steaming vessel 15 is advantageously around 1.3 bar, the run-through time is around 1.5 minutes, and the temperature is approximately 125° C.

Arranged inside the sloping steaming vessel 15 there is a conveyor screw 17 which screws the material, i.e. the wood chips, up through the steaming vessel 15 to a chip chute 18 via a low-pressure feeder 34, whose purpose it is to permit a lower pressure at the top of the chip chute 18 than inside the steaming vessel 15. By means of the fact that the steaming vessel 15 slopes down rearwards, an excess 19 of pre-impregnation liquid, which has been heated during steaming by the steaming vapour 16, can be separated off and thereafter conveyed to a heat exchanger 20, in order to be transported from there in a first subsidiary stream of liquor 21 to a chemical recovery system 48 of the pulp mill, while a second subsidiary stream of liquor 22 is pumped to the aforementioned pressure vessel 11 which drives the discharge device 10.

After the low-pressure feeder 34, the overpressure is released and the air 23 which, during steaming, has been forced out from the pre-impregnated material, i.e. the wood chips, is separated off with the aid of a condenser 24. Non-condensable gases 25 are led from the condenser 24 to a conventional system 50 for managing foul-smelling gases while the contaminated condensate 26 is led to a corresponding condensate system 52 for managing such condensate.

After the chip chute 18, the pre-impregnated and steamed material, i.e. the wood chips 27, is conveyed to a pulp digester 29 with the aid of a high-pressure feeder 28. This pulp digester 29 functions in accordance with the prior art and will therefore not be described in detail.

The pulp digester 29 is provided at its upper part with a special top separator 30 which allows transport liquid 31 to be separated from the chips and conveyed to the high-pressure feeder 28.

The chip chute circulation running from the bottom of the high-pressure feeder 28 is conveyed to the heat exchanger 20 in order to be heated therein, by the aforementioned excess 19 of pre-impregnation liquid which has been heated by the steaming vapour 16, before return to the chip chute 18. Thereafter, the excess 19 is pumped onwards to chemical recovery. A subsidiary stream 22 is returned, however, to the aforementioned pressure vessel 11 in order to feed chips to the steaming vessel 15 via the discharge device 10.

The process system according to the invention uses the large amount of existing thermal energy which the cooking liquid in the pulp digester 29 possesses due to the relatively high temperatures and pressures prevailing in the pulp digestion.

In implementing the present invention, the energy consumption is reduced by the fact that flashing of extraction liquor is used for generating steaming vapour, and by the fact that hot extraction liquor is used for pre-impregnation in the process vessel 1. The aforementioned heat exchange in conjunction with the sloping steaming vessel and the high-pressure feeder further reduce energy consumption.

Possible foul-smelling gases are removed from the process system according to the invention through the gas outlet 8 or via the condenser 24 in order thereafter to be conveyed to a system, known per se, for management of foul-smelling gases. The risk of such gases dispersing into the environment is minimized in this way.

The invention has been described above by way of a preferred embodiment. However, the invention is not in any way limited to what has been described in conjunction with the said embodiment, or to what is shown in the attached figure, and can of course be varied within the scope of the attached patent claims.

Thus, for example, instead of a high-pressure feeder, it is possible to use a special pump arrangement which is described in PCT/SE97/00627.

In addition, it will be appreciated that various types of additives such as chelating agents, anthraquinone compounds and the like can be added in, for example, the first process vessel 1.

Embodiments of the invention are also possible in which fresh steam is used in the steaming vessel 15 instead of steam from flashing of extraction liquor.

While the present invention has been described in accordance with preferred compositions and embodiments, it is to be understood that certain substitutions and alterations may be made thereto without departing from the spirit and scope of the following claims.

What is claimed is:

1. A method for preliminary treatment of a disintegrated cellulose-containing material prior to pulp digestion, comprising:

(a) providing a pressure in a process vessel that is substantially similar to an atmospheric pressure;

(b) pre-impregnating the cellulose-containing material in the process vessel with a sulphur-containing alkaline liquor, the cellulose-containing material flowing in a downstream flow direction;

(c) feeding the pre-impregnated cellulose-containing material to a sloping steaming vessel, the sloping vessel being downstream of the process vessel;

(d) separating off an amount of the liquor from the cellulose-containing material in the sloping steaming vessel, the amount being a substantial portion of a total amount of the liquor to be conveyed to a chemical recovery unit;

(e) steaming the pre-impregnated cellulose-containing material in the sloping steaming vessel;

(f) passing the liquor from step (d) through a heat exchanger;

(g) dividing the liquor from step (f) into a first subsidiary stream and a second subsidiary stream;

(h) flashing an extraction liquor from pulp digestion to generate a steaming vapor for steaming in step (e); and (i) collecting and condensing foul-smelling gases from steps (b) and (e).

2. The method of claim 1 wherein the method further comprises conveying the first subsidiary stream to the chemical recovery unit, conveying the second subsidiary stream to a pressure vessel and feeding the pre-impregnated cellulose-containing material from a discharge device of the process vessel to the sloping steam vessel.

3. A system for a preliminary treatment of a disintegrated cellulose-containing material prior to a pulp digestion, comprising:

a process vessel for pre-impregnating the cellulose-containing material disposed therein with a pre-impregnation liquid, the process vessel being operable at a pressure that is substantially similar to an atmospheric pressure;

a sloping steaming vessel in fluid communication with and downstream of the process vessel for steaming the pre-impregnated cellulose-containing material;

an excess conduit in operative engagement with the steaming vessel for separating excess pre-impregnation liquid from the pre-impregnated cellulose-containing material;

a high-pressure feeder, in fluid communication with the steaming vessel, attached to a pulp digester;

a flashing mechanism in operative engagement with the pulp digester for flashing an extraction liquor received from the pulp digester to generate a steaming vapor, the steaming vessel in fluid communication with the flash mechanism for receiving the steaming vapor therefrom;

a chip chute in operative engagement with the steaming vessel; and a condenser in fluid communication with the chip chute and with a system for managing foul-smelling process gases generated from the process vessel and the sloping steaming vessel.

4. The process system according to claim 3 wherein the excess conduit is in fluid communication with a heat exchanger so that the excess pre-impregnation liquid is passable through the heat exchanger, and the pre-impregnation liquid comprises the extraction liquor from the pulp digester and the excess pre-impregnation liquid is dividable into a first subsidiary stream of liquor and a second subsidiary stream of liquor after the pre-impregnation liquid has passed through the heat exchanger, the first subsidiary stream of liquor is in fluid communication with a chemical recovery system, the second subsidiary stream of liquor is conveyable to a pressure vessel in fluid communication with the heat exchanger, the pressure vessel is in fluid communication with a discharge unit of the process vessel.

5. The system according to claim 3 wherein the process vessel has a top opening defined therein and a valve flap is attached to the process vessel at the top opening, the process vessel has a gas outlet defined therein that is in fluid communication with a foul-smelling gas process system for managing foul-smelling process gases.

6. The system according to claim 3 wherein the process vessel has a plurality of liquid inlets defined therein for receiving the pre-impregnation liquid at different heights of the process vessel to control temperatures inside the process vessel so that a top of the process vessel has a temperature that is less than 100° C. and a bottom of the process vessel has a temperature that is higher than 100° C.

7. The system according to claim 3 wherein a low-pressure feeder is disposed between the steaming vessel and the chip chute so that a top portion of the chip chute has a pressure that is lower than a pressure inside the steaming vessel.

* * * * *